US005893454A

United States Patent [19]

Hermanek

[11] Patent Number: 5,893,454

[45] Date of Patent: Apr. 13, 1999

[54] TUBULAR HUMIDOR WITH A RETRIEVAL MECHANISM

[76] Inventor: Edward Hermanek, 834 Columbia, Darien, Ill. 60561

[21] Appl. No.: 08/963,295

[22] Filed: Nov. 3, 1997

[51] Int. Cl.[6] ..... A45F 15/00

[52] U.S. Cl. ..... 206/255; 206/249; 206/205; 206/804

[58] Field of Search ..... 206/204, 205, 206/209.1, 249, 254, 255, 804, 817

[56] References Cited

U.S. PATENT DOCUMENTS

| | | | |
|---|---|---|---|
| 629,586 | 7/1899 | McIntyre | 206/804 |
| 1,051,433 | 1/1913 | Moseley et al. | 206/209.1 |
| 1,249,610 | 12/1917 | Freymann | 206/254 |
| 1,902,963 | 3/1933 | Lepage et al. | 206/254 |
| 3,236,588 | 2/1966 | Emerson | 206/804 |
| 3,589,505 | 6/1971 | Burniski | 206/804 |
| 4,907,604 | 3/1990 | Beloff | 131/256 |
| 4,997,082 | 3/1991 | Durocher | 206/204 |
| 5,011,009 | 4/1991 | Scheurer | 206/270 |
| 5,607,051 | 3/1997 | Espinosa | 206/213.1 |

*Primary Examiner*—David T. Fidei

*Attorney, Agent, or Firm*—Marshall, O'Toole, Gerstein, Murray & Borun

[57] ABSTRACT

This disclosure describes a tubular humidor with a mechanism for retrieving cigars stored therein. The tubular humidor includes a tubular member having an open end and a closed end and a mechanism for covering the open end of the tubular member, thereby isolating the interior of the tubular humidor from the ambient environmental conditions. The retrieval mechanism is inserted into the tubular humidor concurrently with the cigars to be stored therein. When the covering mechanism is disengaged and pulled away from the open end of the tubular humidor, the retrieval mechanism biases the cigars through the open end for retrieval by the cigar smoker. The tubular humidor further comprises a replaceable humidifier which may be an integral component of the retrieval mechanism.

20 Claims, 3 Drawing Sheets

TUBULAR HUMIDOR WITH A RETRIEVAL MECHANISM

BACKGROUND OF THE INVENTION

1. Field of the Invention

The present invention relates to humidors and, more particularly, to a tubular humidor with a mechanism for retrieving one or more cigars stored therein.

2. Description of Related Art

Cigar smoking has been subject to renewed popularity in 1990's. Nowhere is the popularity of cigars more evident than on the golf course. The focus of this renewed popularity has been fine cigars made of natural leaf tobacco throughout. Unfortunately, the leaf tobaccos used in fine cigars are very delicate, and their flavor can only be preserved by maintaining control over the moisture content of the cigar. Therefore, it is desirable to have a portable container which controls the moisture content of the cigars for transporting a small cache of cigars out to the golf course or other remote location where the cigars will be smoked.

The typical prior art humidor is a wooden box with a hinge top. Interior portions of the box are dimensioned to protectively surround a supply of cigars. The box humidors also include a source of humidity that delivers moisture to the cigars in the humidor. Some prior art humidors include a moisture-retaining pad at an upper location in the humidor, such as in the cover. The moisture-retaining material in the cover may be periodically replaced or remoistened to maintain a desirably high level of humidity. One example of such a prior art humidor is shown in U.S. Pat. No. 5,607,051, which illustrates a cigar humidor with multiple compartments for storing cigars.

Box shaped humidors of the type described above are ideal for long-term storage of a large number of cigars in the home or office. However, these humidors are too large and awkward to be conveniently transported out to a golf course or other remote location. The box humidors are too cumbersome to either carry along with other equipment or store within one of the compartments of a bag or other container used to transport equipment. Therefore, a need exists for a humidor which can store several cigars and can be easily transported along with other equipment being carried by the smoker.

In an effort to preserve the freshness of a cigar during storage and transportation, manufacturers have sealed their cigars in individual cigar tubes. One example of a cigar storage tube is shown in U.S. Pat. No. 5,011,009. Although these tubes provide a sealed environment for transporting a single cigar, the tubes are not designed to provide humidity control for the cigar stored therein. The cigar tube in the above-cited patent provides an adjustable opening which exposes the stored cigar to the regulated environment of a humidor. While the individual cigar tubes are small enough to be transported in a container or a bag, they are not designed to provide the humidity control necessary to maintain the moisture content of the cache of cigars which may be stored for a period of time before being smoked.

In view of the above, it is an object of the present invention to provide a tubular humidor adapted for storing cigars which can be stored in or mounted on a golf bag or other container for transporting equipment for extended periods of time. Due to the increased size of the tubular humidor over the prior art individual cigar tubes, the present invention further includes a retrieval mechanism for extracting the cigar(s) stored therein without the need to completely remove the humidor from the golf bag or container.

SUMMARY OF THE INVENTION

The present invention is directed to a container for storing and transporting at least one cigar having a tubular member with a closed end, an open end, and an interior cavity, and a means for covering the open end of the tubular member adapted to demountedly engage the open end and to isolate the interior cavity of the tubular member from ambient environmental conditions during engagement. The container further comprises a means for retrieving the cigars stored within the container which is placed into the interior cavity of the tubular member concurrently with the stored cigar(s) when the covering means engages the open end. When the covering means is disengaged and drawn away from the open end, the retrieving means biases the stored cigar(s) through the open end of the tubular member.

In another embodiment of the present invention, the container further comprises the humidifier adapted for placement in the interior cavity concurrently with the retrieving means and the stored cigar(s) when the covering means engages the open end. In yet another embodiment, the humidifier is an integral component of the retrieving means. In this embodiment, the retrieving means has a proximal end connected to the covering means and a distal end connected to the humidifier. The humidifier is placed in the tubular member prior to insertion of the stored cigar(s) and has a surface adapted to abut a cigar stored proximate to the closed end of the tubular member. When the covering means is disengaged and drawn away from the open end, the humidifier biases the stored cigar(s) through the open end of the tubular member.

The features and advantages of the invention will be apparent to those of ordinary skill in the art in view of the detailed description of the preferred embodiment, which is made with reference to the drawings, a brief description of which is provided below.

DETAILED DESCRIPTION OF THE PREFERRED EMBODIMENTS

Figure 1:
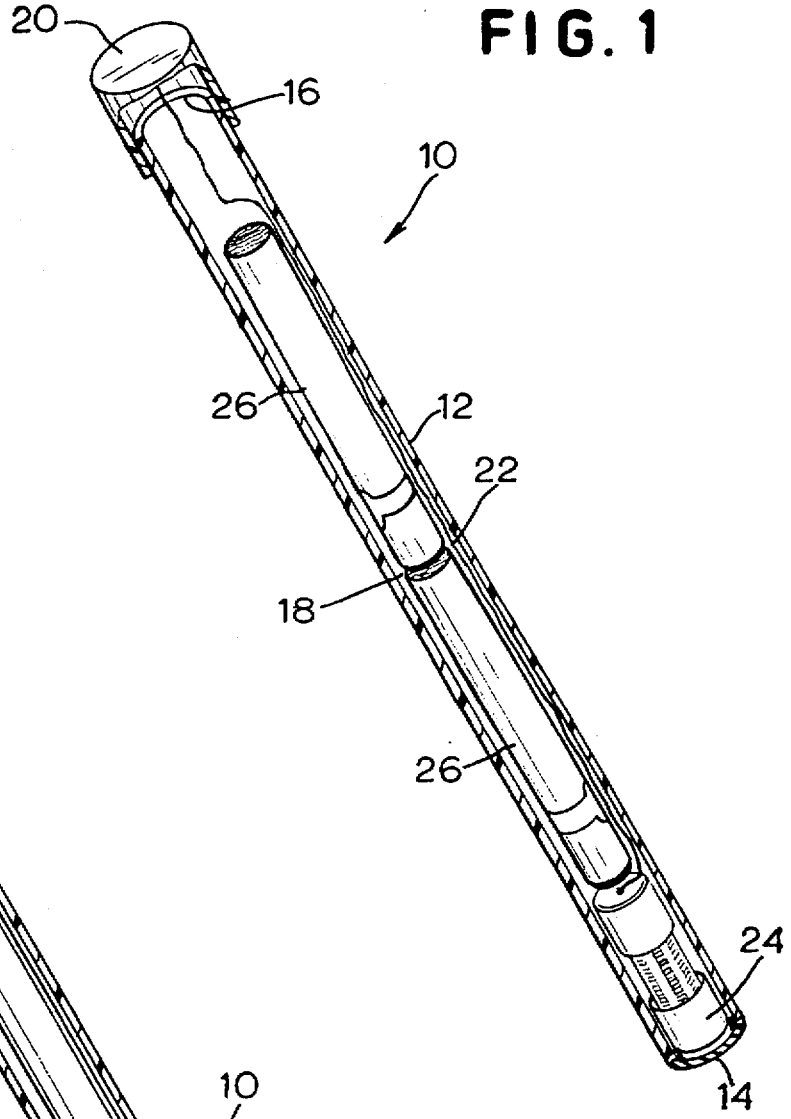
FIG. 1 is a perspective partial section view of a tubular humidor with a retrieval mechanism with two cigars stored therein in accordance with the present invention.
Figure 2:
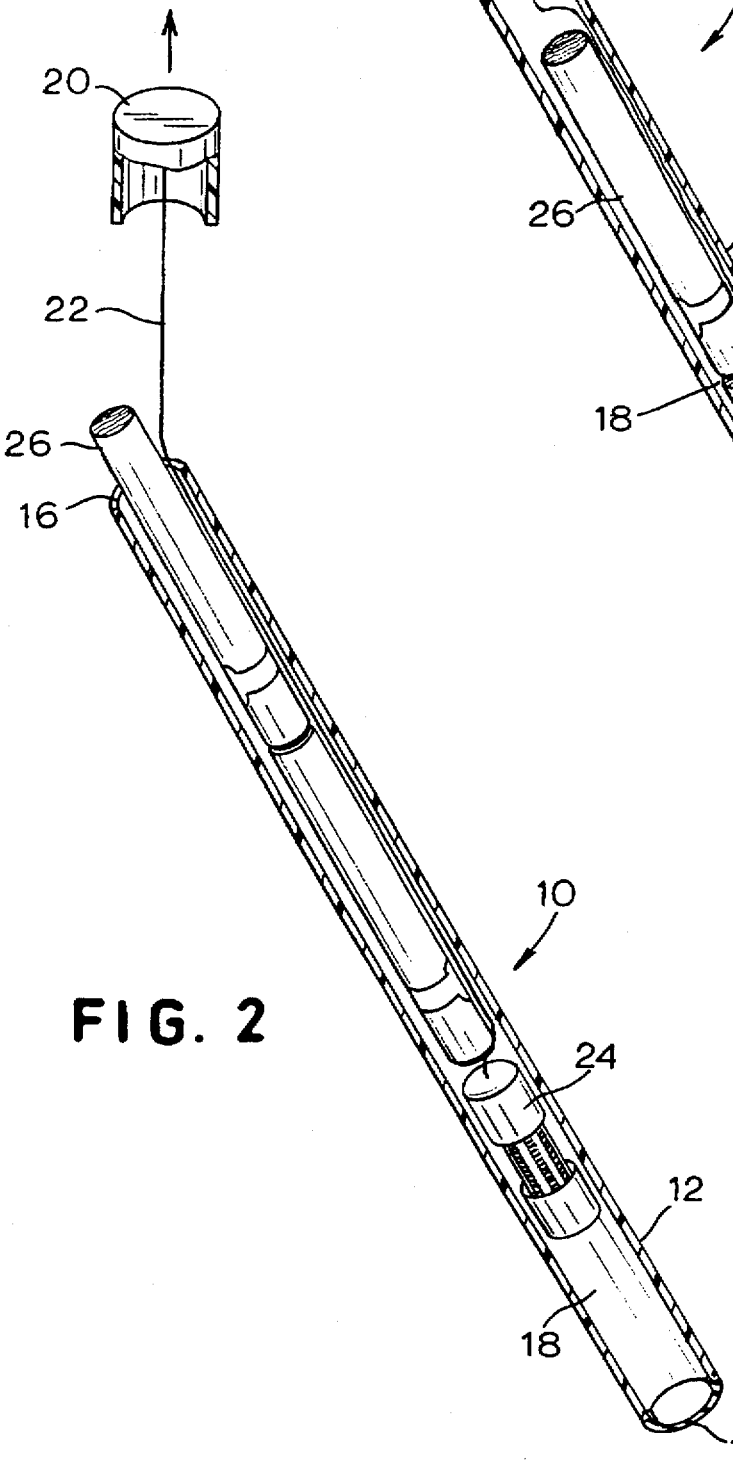
FIG. 2 is a perspective partial section view of the tubular humidor of FIG. 1 showing the retrieval of a stored cigar.

The first embodiment of a tubular humidor with a retrieval mechanism 10 in accordance with the present invention is shown in FIGS. 1 and 2. Referring to FIG. 1, the tubular humidor 10 includes a tubular member 12 having a closed end 14, an open end 16, and an internal cavity 18. The tubular humidor 10 further includes a cap 20 which frictionally engages the open end 16 and forms a seal which isolates the interior cavity 18 of the tubular member 12 from ambient environmental conditions during engagement. A line 22 is attached at one end to the cap 20 and at the opposite end to a humidifier 24. The line 22 and humidifier 24 form the retrieval mechanism in this embodiment of the present invention.

FIG. 1 illustrates the tubular humidor 10 with a plurality of cigars 26 stored therein. The humidifier 24 is first inserted into the open end 16 of the tubular member 12. The cigars 26 are then inserted into the tubular member 12 through the open end 16 and come to rest upon the humidifier 24. The line 22 runs the length of the tubular member 12 and connects the cap 20 to the humidifier 24. The cap 20 is then placed on the open end 16 of the tubular member 12 with the inner surface of the cap 20 fictionally engaging the outer surface of the open end 16. In this way, the cap 20 seals the tubular humidor 10 and isolates the interior cavity 18 of the tubular member 12 from the ambient environmental conditions. The tubular humidor 10 can then be inserted into a compartment of the golf bag or other container (not shown), such as the long vertical pocket present on most golf bags. Alternatively, a longer version of the tubular humidor 10 can be inserted into the open end of the golf bag along with the golfer's golf clubs.

FIG. 2 illustrates the retrieval of a cigar 26 stored in the interior cavity 18 of the tubular humidor 10 in accordance with the present invention. The cap 20 is removed from the open end 16 of the tubular member 12 and pulled away from the open end 16. As the cap 20 is pulled away from the open end 16, the line 20 pulls the humidifier 24 toward the open end 16. The top surface of the humidifier 24 abuts the cigar 26 stored proximate thereto, thereby causing the cigar 26 to pass through the open end 16 of the tubular member 12. Once the cigar(s) 26 has (have) been removed, the humidifier 24 and line 22 are reinserted into the tubular members 12 and the cap 20 is reapplied to the open end 16. The retrieval mechanism disclosed herein allows the golfer to extract cigars 26 from the tubular humidor 10 without the necessity of removing the entire tubular humidor 10 from the golf bag.

Figure 3:
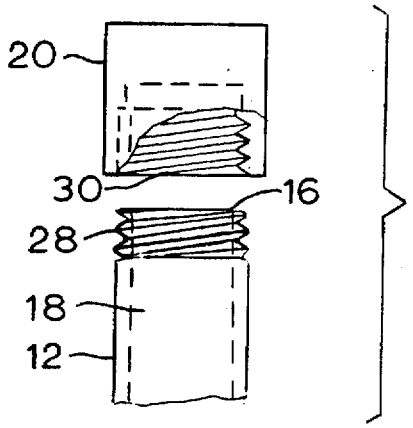
FIG. 3 is a side view of an alternative embodiment of the tubular humidor in accordance with the present invention wherein the open end and the covering means include mating threaded portions.
Figure 4:
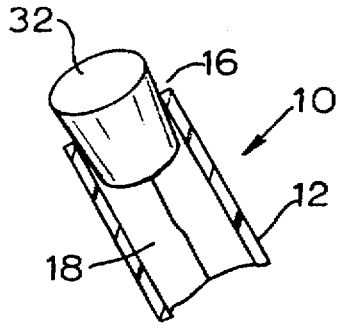
FIG. 4 is a perspective partial section view of another embodiment of a tubular humidor in accordance with the present invention wherein a plug is used to seal the open end of the tubular member.

Although the friction fitting cap 20 is shown in FIGS. 1 and 2, other mechanisms for covering the open end 16 of the tubular member 12 to isolate the interior cavity 18 are possible. For example, FIG. 3 illustrates the tubular member 12 with a threaded portion 28 proximate the open end 16, and cap 20 with a threaded portion 30 on the interior surface of the cap 20. The threaded portions 28, 30 are designed to mate and thereby seal the interior cavity 18. FIG. 4 illustrates another alternative embodiment whereby a plug 32 having an outer surface fictionally engages the interior surface of the open end 16. In yet another alternative embodiment, the plug 32 includes a threaded portion on the outer surface and the open end 16 includes a threaded portion on the interior surface such that the threaded portions mate and form a seal which isolates the interior cavity 18 from the ambient environmental conditions. Other covering mechanisms that can be used with the tubular humidor described herein will be obvious to those of ordinary skill in the art and are contemplated by the inventor as having use in connection with the present invention.

As previously discussed, the retrieval mechanism illustrated in FIGS. 1 and 2 is comprised of a line 22 connected at one end to the cap 20 and at the other end to the humidifier 24. The line 22 can be made of any material strong enough to withstand the tensile force required to retrieve the cigars 26 stored in the interior cavity 18 of the tubular member 12. Examples of such materials include fishing wire, piano wire, twisted wire, string, rope, cord, or any like material which can withstand the applied tensile loads. Additionally, the humidifier 24 can be replaced in the retrieval mechanism by some other element which can provide a surface which will abut the cigars 26 stored proximate the element and force the cigar 26 through the open end 16 when the cap 20 is pulled away from the open end 16. In this alternative, the humidifier 24 is either inserted into the tubular member 12 prior to insertion of the element and the stored cigars 26, inserted into the tubular member 12 after the cigars 26, or attached directly to the inside of the cap 20. In each embodiment, the humidifier 24 is adapted to be detachable from the line 22 or the cap 20 and replaced by a new humidifier.

Figure 5:
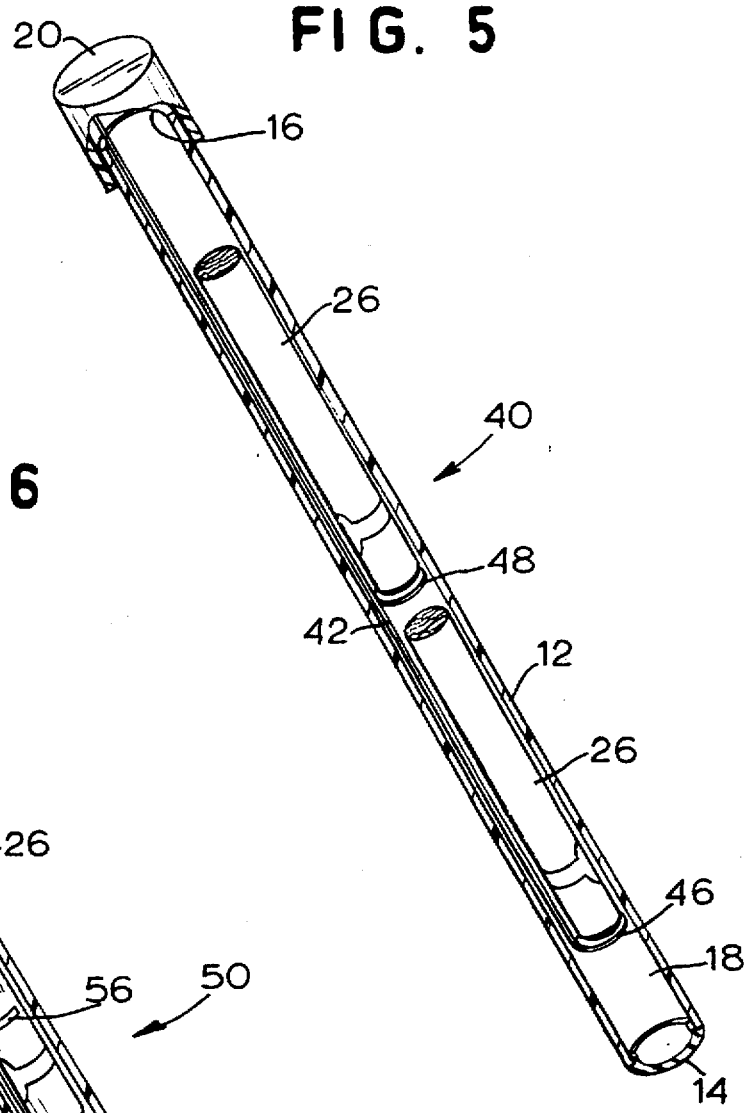
FIG. 5 is perspective partial section view of an alternative embodiment of a tubular humidor in accordance with the present invention wherein the retrieval mechanism is a rigid member.
Figure 6:
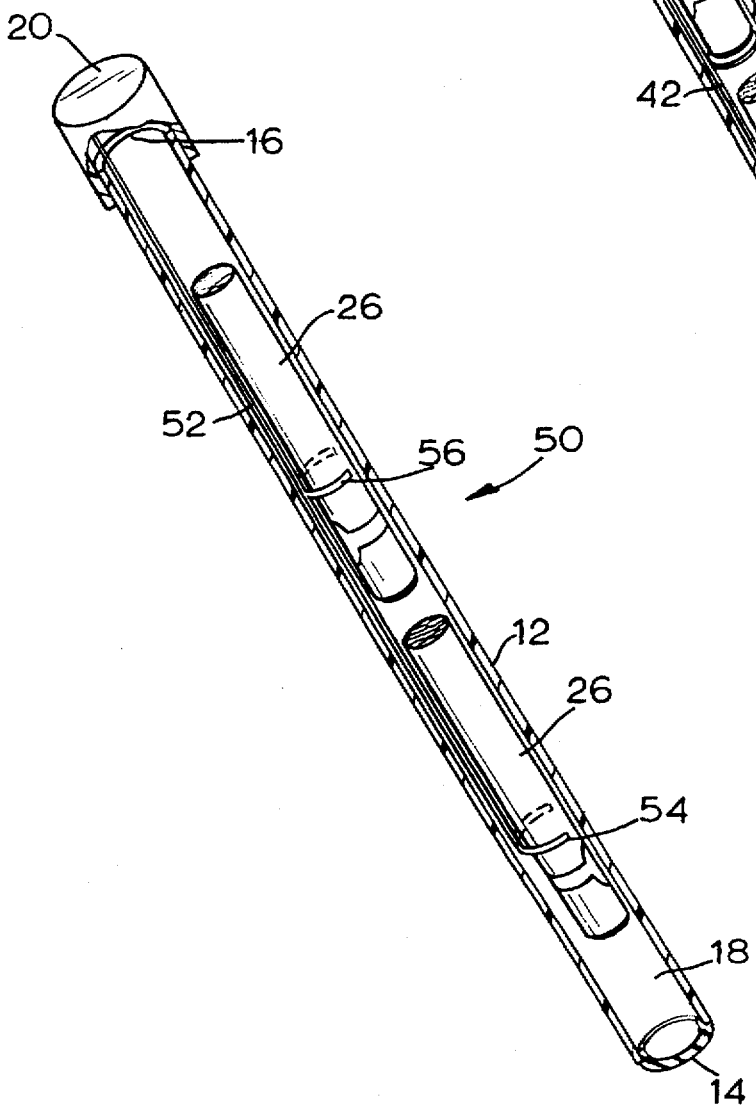
FIG. 6 is a perspective partial section view of an alternative embodiment of a tubular humidor in accordance with the present invention wherein the retrieval mechanism is a rigid member equipped with clamps which retain the stored cigars.

The line 22 can be replaced in the retrieval mechanism by a rigid member which is inserted into the internal cavity 18 of the tubular member 12 concurrently with the stored cigars 26. Examples of such retrieval mechanisms are illustrated in FIGS. 5 and 6. Referring to FIG. 5, tubular humidor 40 has a rigid member 42 attached to the cap 20 which is inserted into the tubular member 12 concurrently with the cigars 26. The rigid member 42 includes a first extension member 46 extending from the rigid member 42 at the end opposite the cap 20. The first extension member 46 provides a surface which abuts the cigar 26 stored proximate the closed end 14 of the tubular member 12. When the cap 20 is disengaged and pulled away from the open end 16, the first extension member 46 forces the cigars 26 through the open end 16 of the tubular member 12 in the same manner discussed previously. The rigid member 42 can include additional extension members 48 interspersed throughout the length of the rigid member 42 to provide a separate storage location for each stored cigar 26.

FIG. 6 illustrates yet another alternative embodiment for the retrieval mechanism in the tubular humidifier 50. In this embodiment, a rigid member 52 is attached to the cap 20 and is inserted concurrently into the interior cavity 18 of the tubular member 12 with the stored cigars 26. The rigid member 52 further includes one or more clamping members 54, 56 which fictionally engage the stored cigars 26 without damaging the cigars 26. Prior to inserting the rigid member 52 through the open end 16, the cigars 26 are attached to the rigid member 52 via the clamps 54, 56. The rigid member 52 and the cigars 26 are then concurrently inserted through the open end 16 and into the internal cavity 18 of the tubular member 12. To retrieve the cigars 26, the cap 20 is disengaged and pulled away from the open end 16, thereby extracting the rigid member 52 and the cigars 26 from the tubular member 12. These retrieval mechanisms are illustrative of the type of retrieval mechanism that can be used with the tubular humidifier of the present invention. Other retrieval mechanisms will be obvious to those of ordinary skill in the art and are contemplated by the inventor as having use in connection with the present invention.

Figure 7:
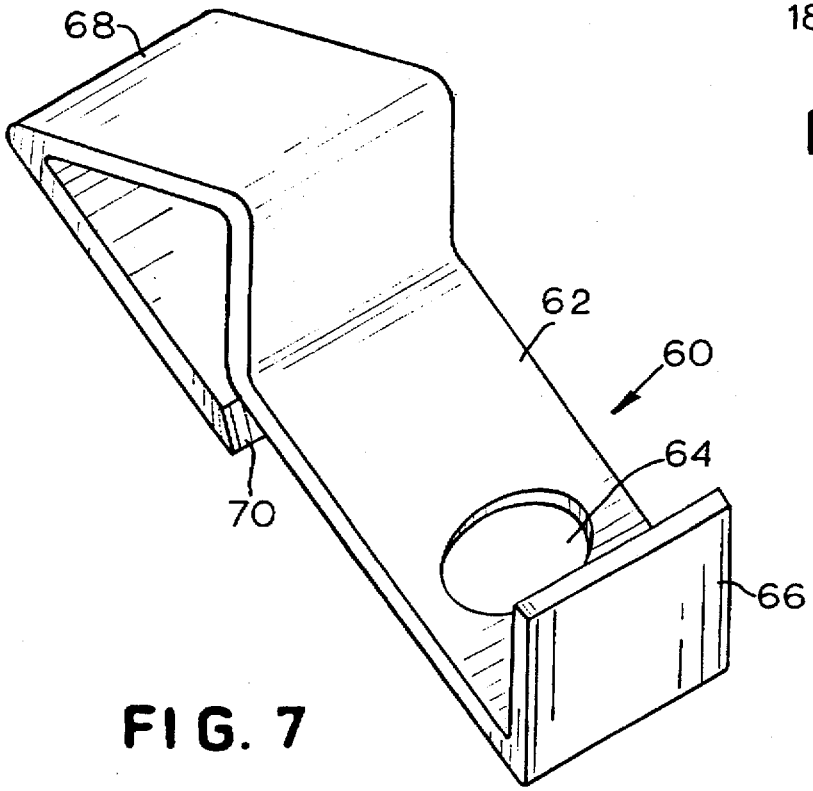
FIG. 7 is a perspective view of a clip for mounting the tubular humidor on the outside of a golf bag or other equipment container.

The tubular humidor of the present invention can also be equipped with an attachment mechanism for affixing the humidor to the outside of a golf bag or other container. FIG. 7 illustrates a clip 60 which can be used to mount the tubular humidor. The clip 60 has a generally flat planar section 62 with a hole 64 having a diameter to allow insertion of a tubular humidor and to frictionally engage the tubular member. A second flat planar section 66 extends from one end of section 62 to stabilize the tubular humidor inserted in the hole 64 while the clip 60 is attached. A hook 68 having an opening 70 extends from the opposite end of section 62. The hook 68 fastens the clip 60 to a bag or container when hook 68 is attached to a part of the container, such as the open end of a golf bag or a strap on the container. The humidor then hangs from the bag or equipment container by the clip 60 and the cigars are retrieved from the humidor without detaching clip 60 by using the retrieval mechanism as described herein. Clip 60 is an example of an attachment mechanism. Other mechanisms will be obvious to those skilled in the art and are contemplated by the inventor as having use in connection With the present invention.

While the present invention has been described with reference to the specific examples, which are intended to be illustrative only and not to be limiting of the invention, it will be apparent to those of ordinary skill in the art that changes, additions, and/or deletions may be made to the disclosed embodiment without departing from the spirit and scope of the invention.

I claim:

1. A container for storing and transporting at least one cigar comprising:

a tubular member having a closed end, an open end and an interior cavity;

a cover member adapted to demountably engage the open end and to isolate the interior cavity of the tubular member from ambient environmental conditions during engagement;

a retrieval mechanism connected to the cover member and having a proximal end connected to the cover member and a distal end;

a humidifier connected to the distal end of the retrieval mechanism and adapted for placement in the interior cavity concurrently with the retrieval mechanism and the at least one cigar when the cover member engages the open end;

whereby the retrieval mechanism, the at least one cigar and the humidifier occupy the interior cavity concurrently and the humidifier is interposed between the closed end and the at least one cigar when the cover member engages the open end and whereby the retrieval mechanism biases the at least one cigar through the open end of the tubular member when the cover member is disengaged and drawn away from the open end of the tubular member.

2. The container of claim 1 wherein the humidifier is demountably connected to the distal end of the retrieval means whereby the humidifier can be disconnected and a second humidifier can be demountably connected to the distal end of the retrieval means.

3. A container for storing and transporting at last one cigar comprising:

a tubular member having a closed end, an open end and an interior cavity;

a cover member adapted to demountably engage the open end and to isolate the interior cavity of the tubular member from ambient environmental conditions during engagement;

a retrieval mechanism connected to the cover member and comprising:

a proximal end connected to the cover member;

a distal end opposite the proximal end; and a humidifier connected to the distal end and having a surface adapted to abut a cigar stored proximate the closed end of the tubular member and to bias the at least one cigar through the open end of the tubular member when the cover member is disengaged and drawn away from the open end of the tubular members;

whereby the retrieval mechanism and the at least one cigar occupy the interior cavity concurrently when the cover member engages the open end and whereby the retrieval mechanism biases the at least one cigar through the open end of the tubular member when the cover member is disengaged and drawn away from the open end of the tubular member.

4. The container of claim 3 wherein the humidifier is demountably connected to the distal end of the retrieval mechanism whereby the humidifier can be disconnected and a second humidifier can be demountably connected to the distal end of the retrieval mechanism.

5. The container of claim 1 wherein the open end of the tubular member further comprises an outer surface and the cover member comprises a cap having an inner surface adapted to demountably engage the outer surface of the open end.

6. The container of claim 5 wherein the inner surface of the cap fictionally engages the outer surface of the open end to thereby demountably engage the cap.

7. The container of claim 5 wherein the inner surface of the cap has a first threaded portion and the outer surface of the open end has a second threaded portion adapted to mate with first threaded portion to thereby demountably engage the cap.

8. The container of claim 1 wherein the open end of the tubular member further comprises an inner surface and the cover member comprises a plug having an outer surface adapted to demountably engage the inner surface of the open end.

9. The container of claim 8 wherein the outer surface of the plug fictionally engages the inner surface of the open end to thereby demountably engage the plug.

10. The container of claim 5 wherein the outer surface of the plug has a first threaded portion and the inner surface of the open end has a second threaded portion adapted to mate with first threaded portion to thereby demountably engage the plug.

11.The container of claim 1 wherein the retrieval mechanism is a line.

12. A container for storing and transporting at least one cigar, comprising:

a tubular member having a closed end and open end and an interior cavity:

a cover member adapted to demountably engage the open end and to isolate the interior cavity of the tubular member from ambient environmental conditions during engagement;

a retrieval mechanism connected to the cover member, comprising:

a rigid member having a proximal end connected to the cover member and a distal end opposite the proximal end; and at least one retrieval member connected to the rigid member and having a surface adapted to engage a cigar stored in the internal cavity of the tubular member and to bias the at least one cigar through the open end of the tubular member when the cover member is disengaged and drawn away from the open end of the tubular member, wherein the at least one retrieval member is adapted to, demountably connect the at least one cigar stored in the internal cavity to the rigid member;

whereby the retrieval mechanism and the at least one cigar occupy the interior cavity concurrently when the cover member engages the open end and whereby the retrieval mechanism biases the at least one cigar through the open end of the tubular member when the cover member is disengaged and drawn away from the open end of the tubular member.

13. The container of claim 1 further comprising means for demountably attaching the container to another object.

14. The container of claim 13 wherein the attaching means comprises a clip adapted detachably engage the tubular member and to demountably attach to the container.

15. A method of storing and retrieving at least one cigar in a tubular container having an open end, a closed end and an internal cavity, the method comprising the steps of:

inserting the at least one cigar and a retrieval mechanism through the open end and into an internal cavity of the container, wherein the retrieval mechanism includes a humidifier inserted into the container prior to the at least one cigar and having a surface adapted to abut a cigar stored proximate the closed end of the container;

covering the open end of the container with a cover member to retain the at least one cigar and retrieval mechanism concurrently and to isolate the interior cavity of the container from ambient environmental conditions;

reopening the open end of the container; and drawing the cover member away from the open end of the container, whereby the at least one cigar is biased through the open end of the container by the humidifier.

16. The container of claim 3, wherein the open end of the tubular member further comprises an outer surface and the covering means comprises a cap having an inner surface adapted to demountably engage the outer surface of the open end.

17. The container of claim 3, wherein the open end of the tubular member further comprises an inner surface and the covering means comprises a plug having an outer surface adapted to demountably engage the inner surface of the open end.

18. The container of claim 3, wherein the retrieval mechanism further comprises a line having a first end that is the proximal end of the retrieval mechanism and a second end that is the distal end of the retrieval mechanism.

19. The container of claim 18, wherein the open end of the tubular member further comprises an outer surface and the covering means comprises a cap having an inner surface adapted to demountably engage the outer surface of the open end.

20. The container of claim 12, wherein the open end of the tubular member further comprises an inner surface and the covering means comprises a plug having an outer surface adapted to demountably engage the inner surface of the open end.

* * * * *